US005603409A

United States Patent [19]

Braverman

[11] Patent Number: 5,603,409

[45] Date of Patent: Feb. 18, 1997

[54] LABEL SYSTEM FOR USE WITH MEDICINAL DISPENSING DEVICE

[76] Inventor: Robert Braverman, 1671 Loretta Ave., Feasterville, Pa. 19053-7393

[21] Appl. No.: 421,596

[22] Filed: Apr. 12, 1995

[51] Int. Cl.[6] ..... B65D 83/04

[52] U.S. Cl. ..... 206/534; 206/459.5; 206/539

[58] Field of Search ..... 206/534, 531, 206/534.1, 539, 459.5

[56] References Cited

U.S. PATENT DOCUMENTS

| | | | |
|---|---|---|---|
| 3,780,856 | 12/1973 | Braverman . | |
| 4,122,651 | 10/1978 | Braverman . | |
| 4,221,329 | 2/1982 | Braverman . | |
| 4,288,065 | 9/1981 | Braverman . | |
| 4,316,541 | 9/1980 | Schneider . | |
| 4,416,375 | 11/1983 | Braverman et al. | 206/534.1 |
| 5,014,851 | 5/1991 | Wick | 206/539 |

*Primary Examiner*—Bryon P. Gehman
*Attorney, Agent, or Firm*—Caesar, Rivise, Bernstein, Cohen & Pokotilwo, Ltd.

[57] ABSTRACT

A medicinal dispensing device preferably including 25 units arranged in a square having five units on a side. Each unit includes flanges having corners and being detachably connected so that each flange may be separated from the remaining flanges. A chamber depends from each flange, has an outer opening and is adapted to hold an article. A closure member covers the chamber openings and has an interior surface which is in contact with the flanges. The interior surface carries a tacky adhesive which contacts the flanges and is protected from adherence by a protective cover sheet. The improvement is that the closure member is a sheet approximately 8.5 inches by 11 inches. The sheet includes an outer surface for printing indicia thereon, an interior surface including a tacky adhesive and a protective cover sheet releasably secured thereto. The closure member includes an upper portion including 25 individual unit labels, each having an interior surface. The 25 unit labels are arranged in a square and are detachably connected along certain perforated lines for separation. The interior surface of each unit label includes the tacky adhesive which contacts the flanges. The lower portion of the closure member includes a plurality of secondary labels. These secondary labels and associated protective cover sheet are perforated along certain lines for removal of each secondary label with its protective cover sheet.

1 Claim, 5 Drawing Sheets

LABEL SYSTEM FOR USE WITH MEDICINAL DISPENSING DEVICE

BACKGROUND OF THE INVENTION

The present invention relates to medicinal dispensing devices and labels used therewith.

The dispensing of various medicines and drugs to patients in a medical facility is necessarily a time consuming task that is generally complicated by the usual large number of patients to be served. This is further complicated by the ever changing composition of patients with continuous admissions and discharges.

It is thus necessary for the person dispensing medicine to a patient to carefully examine the instructions furnished each patient and dispense a particular medication and dosage.

In addition, medical facilities which dispense numerous dosages of medication may wish to pre-package the various dosages for each medication in single-use form, in a disposable container having a label identifying the container contents. Pre-packaging of pharmaceuticals eliminates the need to transfer a particular dosage from a bulk container to an individual container, for example at a hospital pharmacy, in an uncovered receptacle, before it reaches the intended patient. Pre-packaging thus minimizes contamination and mistakes which might occur in the dispensing of various medications.

Various medicinal dispensing devices are known in the prior art. For example in U.S. Pat. No. 3,780,856, assigned to the same assignee of the present invention, and whose disclosure is incorporated by reference herein, is disclosed a medicinal dispensing device for a multiplicity of dosages of a pharmaceutical product. That device comprises a plurality of flanges, each having corners and being attachably connected along weakened lines. A chamber with an outer opening depends from each flange, and a continuous closure member then covers the chambers, with the closure member also being perforated along lines closely corresponding to the weakened lines of the flanges. Certain portions of the interior surface of the closure member are provided with a tacky adhesive coating that is in contact with the flanges and certain other areas of the interior surface of the closure member which are non-tacky and covering the chamber openings. At least one corner of each flange is removed in a cut-away area so that the existing corner of the closure member overlies the cut-away area to function as a lift tab.

In a preferred embodiment of that invention, 25 flanges are detachably connected in a 5×5 pattern, there being a first set of parallel weakened lines in the flanges and a second set of parallel lines being perpendicular to the first set of parallel lines. The connection of the flanges, one to the other, are weaker along the first set of parallel lines and are stronger along the second set of parallel lines whereby it is much easier to sever the set of 25 flanges into five sets of five flanges along the first set of parallel lines. Furthermore, at nine of the intersections between the first and second parallel lines, there are provided circular punched openings, each of which acts as a cutaway area for the four flanges meeting at the intersection of the first and second parallel lines, with the nine punched openings providing at least one cut-away area for each of the 25 flanges.

That type of medicinal dispensing device utilized a closure member comprised of a base bearing a tacky adhesive coating on one surface thereof. A non-stick liner comprised of circular portions prevents the contents of the chamber from becoming adhered to the tacky surface as shown in FIGS. 1–3 and 7 of U.S. Pat. No. 3,780,856. The outer surface of each of the plurality of closure members 22 was adapted to contain writing or other instructions to the patient or professional practitioner. As shown in FIG. 7 of U.S. Pat. No. 3,780,856, one sheet could be used to prepare 25 dosages, since one sheet would provide 25 individual dosage labels to be placed on top of the chamber.

The design of the dimensions and characteristics of the sheet shown in FIG. 7 enabled information to be hand written onto each of the 25 labels produced, for example, information about content, dosage, manufacturer, etc. In addition, that sheet of labels was also utilizable with early types of printers (e.g., dot matrix printers) attached to personal computers which utilized continuous feeding, perforated sheets (e.g., 8.5 inches by 11 inches) attached to one another for printing matter thereon. The sheet design of the '856 patent enabled the entire sheet to be utilized for printing 25 labels, without any concomitant waste of unused paper.

With the advance of computers and associated printers, laser and bubble jet printers are commonplace. Rather than printing on continuous feed perforated sheets however, these printers generally use standard paper sizes, e.g., 8.5 inches by 11 inches, which can either be manually fed, or automatically fed via a paper cartridge to impart an image thereon. Since the label sheet of the '856 invention was not of the standard page size of 8.5 inches by 11 inches, the label sheet had the potential for not being utilizable with laser printers or required adapting the printer to the unusual size of the sheet.

Since these laser printers are adapted to utilize standard size papers, the present invention enables the use of the sheet portion 22 of the '856 invention with laser and bubble jet printers by permitting the same 5×5 arrangement of labels to be produced at the upper portion of the sheet, with additional labels being printed at the lower portion of the sheet, on a standard 8.5 inch by 11 inch sheet. The sizes and numbers of additional labels which may be printed on the lower portion of the label sheet can be varied depending upon the circumstances of use. One embodiment of the invention includes six 1 by 3 inch labels as the additional labels. The indicia used to print on all the labels of the sheet of the present invention can be applied manually or by computer program of a type which is well within the knowledge of one skilled in the art.

Using standard size sheets, such as those of the present invention, minimizes jamming which might occur on certain printers if oddly-sized sheets were inserted therein. Jamming of label sheets is a great concern to the end user because of the extremely tacky nature of the adhesive utilized on the underside of the sheet used to make the 5×5 labels. Jamming of an adhesive sheet, used with such medicinal dispensing devices, is to be avoided. If the protective backing is removed during the printing process and the adhesive contacts the roller or other parts of a laser or other similar type of printer, it could cause serious damage to the printer and associated components, thus causing the end user to incur extreme aggravation, down time in printing additional labels which may be urgent in a hospital and emergency setting and substantial repair costs. Accordingly, a need exists for a laser label to be used in connection with a medicinal dispensing device.

Other types of medicinal devices are disclosed in the following U.S. Patents, the full disclosures of which are also incorporated by reference herein: U.S. Pat. No. 4,122,651; U.S. Pat. No. 4,316,541; U.S. Pat. No. 4,288,065; and U.S. Pat. No. 4,221,329 (Braverman).

OBJECTS OF THE INVENTION

Accordingly, it is a general object of this invention to overcome the disadvantages of the prior art.

It is a further object of this invention to provide a label which minimizes wasted paper and labels.

It is another object of this invention to utilize a label sheet which is of standard size to minimize jamming and potential damage to a printer printing indicia on that sheet.

It is yet another object of this invention to utilize a label sheet which is versatile.

SUMMARY OF THE INVENTION

These and other objects of this invention are achieved by providing a medicinal dispensing device comprising 25 units arranged in a square having five units on a side. Each unit includes flanges having corners and being detachably connected along certain lines so that each flange may be separated from the remaining flanges, a chamber depending from each flange, the chamber having an outer opening. The chamber is adapted to hold an article. A closure member covers the chamber openings, the closure member having an interior surface which is in contact with the flanges. The interior surface of the devices carries a tacky adhesive which contacts the flanges, the interior surface being protected from adherence to an undesired object by being covered with a protective cover sheet. The closure member is perforated along certain lines closely corresponding to the flange lines. At least one corner of each flange is removed in a cut-away area to facilitate separation of the portion of the closure member in contact with each flange. The flange is detachably connected along first and second groupings of weakened lines, generally perpendicular to each other. The weakened lines meet in 16 intersections consisting of 12 outer intersections and four inner intersections, as well as a punched opening at the intersection which constitutes the fourth corner of a square.

The improvement is in the provision of a closure member comprising a sheet approximately 8.5 inches by 11 inches in dimension, the sheet includes an outer surface for printing indicia thereon, an interior surface including a tacky adhesive and a protective cover sheet releasably secured thereto to prevent the adherence of the closure member to an undesired object. The closure member further includes an upper portion having 25 individual unit labels, each having an interior surface, the 25 unit labels being arranged in a square with five unit labels on a side, each of the unit labels having corners and being detachably connected along certain perforated lines so that each unit label may be separated from the remaining unit labels. The interior surface of each unit label includes the tacky adhesive which contacts the flanges. The closure member further includes a lower portion comprising a plurality of secondary labels, the secondary labels and underlying associated protective cover sheet being perforated along certain lines. The secondary labels have corners and are detachably connected along certain perforated lines so that one or all of the secondary labels may be separated from the remaining secondary labels while each secondary label still maintains its protective cover sheet. The interior surface of each secondary label includes a tacky adhesive which enables the secondary label to be adhered to a surface.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENT

Figure 1:
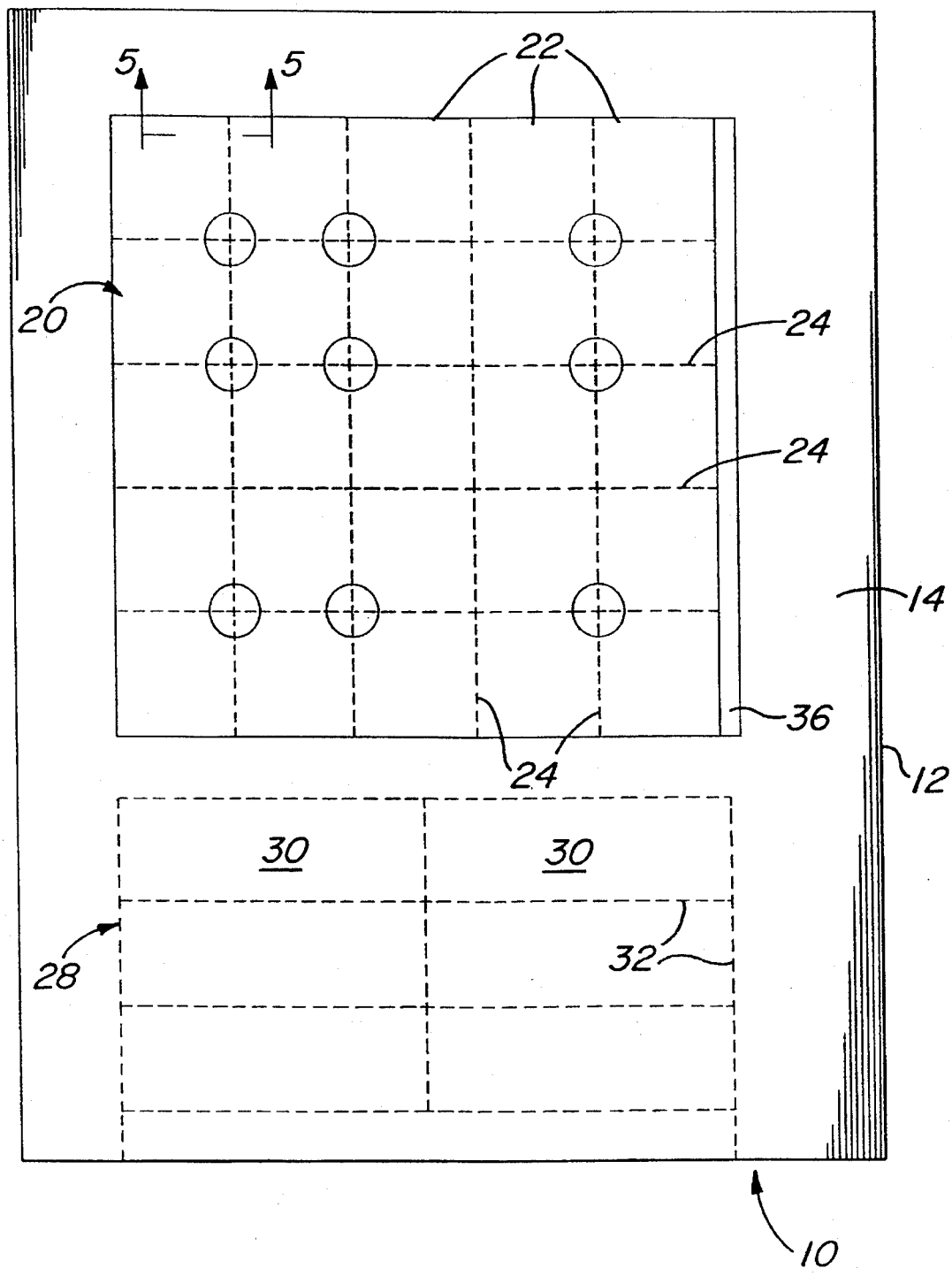
FIG. 1 is a top view of a label sheet or closure member of a first embodiment of the present invention.

Referring now to various figures of the drawings where like reference numerals refer to like parts, there is shown at 10 in FIG. 1, a closure member 10 constructed in accordance with this invention.

Figure 2:
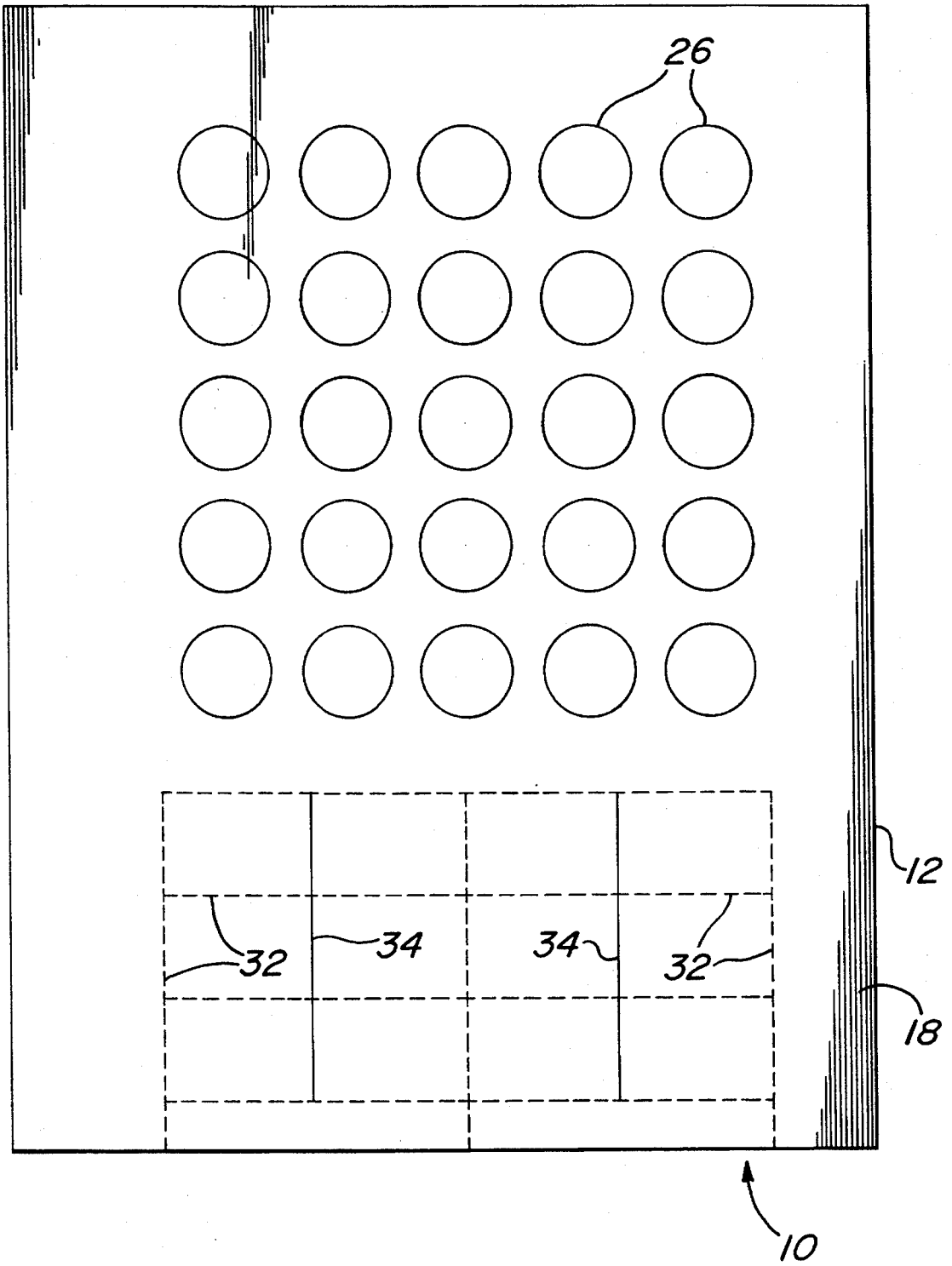
FIG. 2 is a bottom view of the label sheet of FIG. 1.
Figure 5:
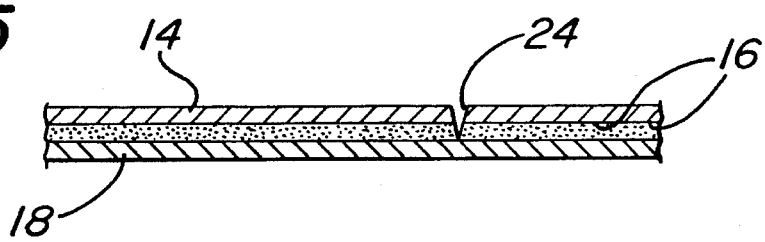
FIG. 5 is a cross-sectional view of the label sheet of FIG. 1, taken along lines 5—5 of FIG. 1.
Figure 6:
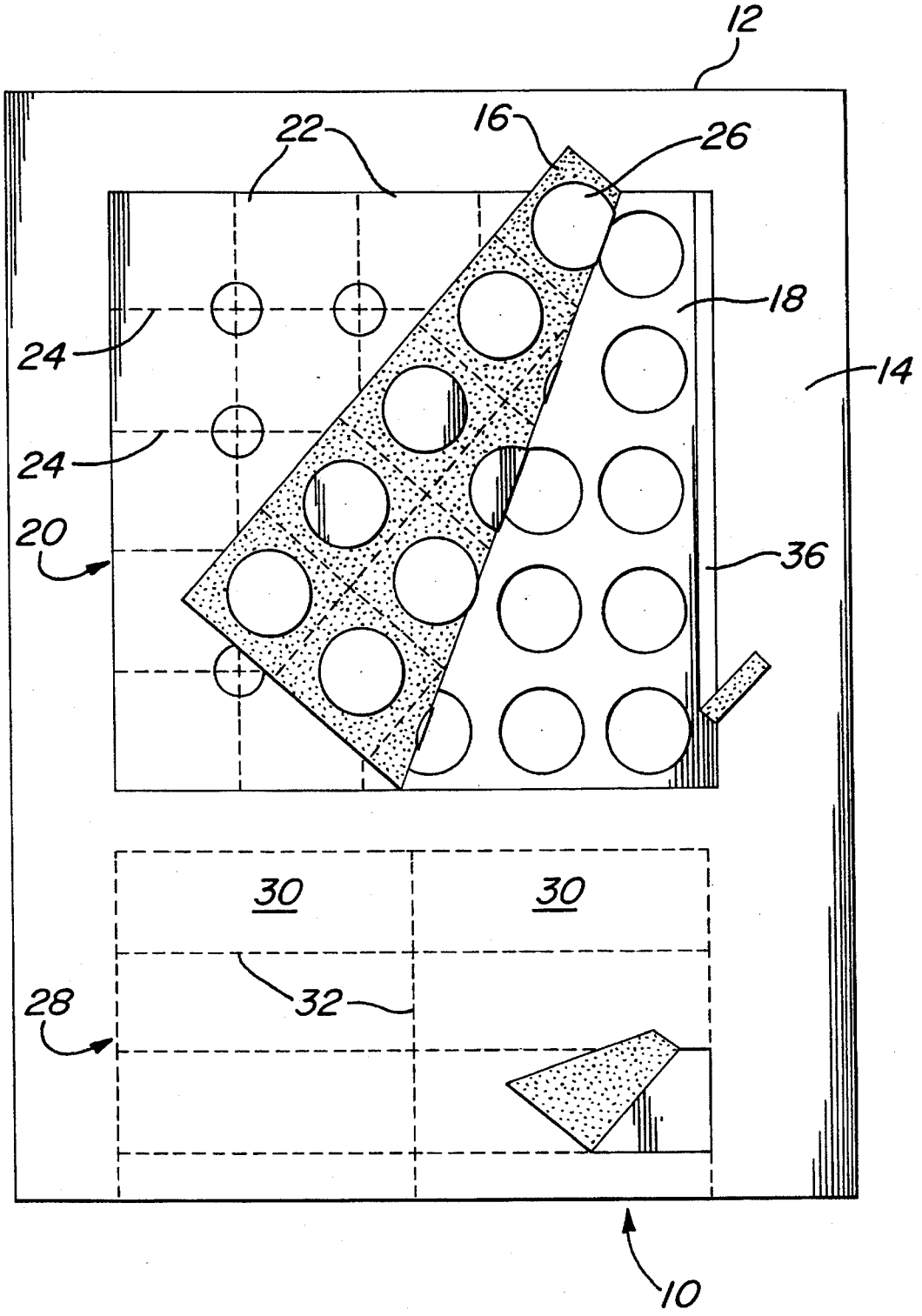
FIG. 6 is of view similar to FIG. 1, but wherein portions of the protective cover sheet and of one of the secondary labels have been partially removed to show underlying portion of the medical dispensing system.

As shown in FIG. 1, the closure member 10 comprises in a first embodiment of the invention, a sheet 12 approximately 8.5 inches wide by 11 inches long. The sheet includes an outer surface 14 for printing indicia thereon. As shown in FIG. 5, the sheet includes an interior surface 16 including a tacky adhesive and a protective cover sheet releasably secured thereto to prevent the adherence of the closure member to an undesired object. The closure member 10 further comprises an upper portion 20 comprising twenty-five individual unit labels 22, each having an interior surface 14, as shown in FIG. 5. The twenty-five unit labels 22 are arranged in a square having five units on a side. Each of the unit labels 22 have corners and are detachably connected along certain perforated lines 24 so that each unit label 22 may be separated from the remaining unit labels on the sheet 12. The interior surface 14 of each unit label 22 includes a tacky conventional adhesive which contacts the flanges (not shown). As shown in the embodiment shown in FIGS. 1 and 2, the perforated lines 24 extend only through the sheet 14 and not through the protective cover sheet 18, although obviously this can be varied depending upon the circumstances of use. In addition, as shown in FIG. 2, the circular punched openings 26 of the protective sheet 18 act as a cut-away area for the four flanges meeting at the intersection of the vertical and horizontal perforated lines 24 as explained further in U.S. Pat. No. 3,780,856.

As shown in FIG. 1, the closure member 10 further includes a lower portion 28 comprising a plurality of secondary labels 30. The secondary labels 30 and underlying associated protective cover sheet shown in FIG. 2, are both perforated along certain vertical and horizontal lines 32. The secondary labels 30 are detachably connected along performed lines 32 so that one or all of the secondary labels 30 may be separated from the remaining secondary labels with each secondary label still maintaining its protective cover sheet 18.

The interior surface (not shown) of each secondary label 30 also includes a tacky adhesive as with the labels 22, which enables the secondary label to be adhered to a surface (not shown). As shown in FIG. 2, the lower portion 28 includes vertical cuts 34 in the protective cover sheet 18 to aid in peeling the protective cover sheet 18 away from the secondary labels 30 when desired. Of course, perforations of the cover sheet 18 may also be used depending upon the circumstances of use. It should be noted that the lower portion 28 includes vertical perforations 32 all the way through to the end of the sheet 12, to permit the entire lot of secondary labels 30 to be removed from the sheet as desired. In the embodiment shown in FIGS. 1 and 2, the number of secondary labels consists of six individual labels 30, approximately 1 by 3 inches, although the number and size can vary depending upon the desired circumstances. These secondary labels 30 can be used for a wide variety of purposes such as for labeling of pharmaceutical bins and other uses, thus, minimizing the amount of wasted space on a sheet 12.

In addition, the sheet 12 may include a longitudinal area 36, for the printing of advertising or other indicia thereon. The labels 22 and 30 may also contain indicia thereon, including name and brand of pharmaceutical, name of patient, dosage and any other desirable indicia. This indicia may be applied manually or via a computer program designed to control an associated printer to print the indicia thereon. Such a computer program is available from Medi-Dose, Inc. of Feasterville, Pa., and is generally known to those skilled in the art. It is preferable that the sheet 12 of the present invention be fed into a laser or bubble jet printer (not shown) with the upper portion 20 entering the printer first, to minimize potential jamming of the printer.

Figure 3:
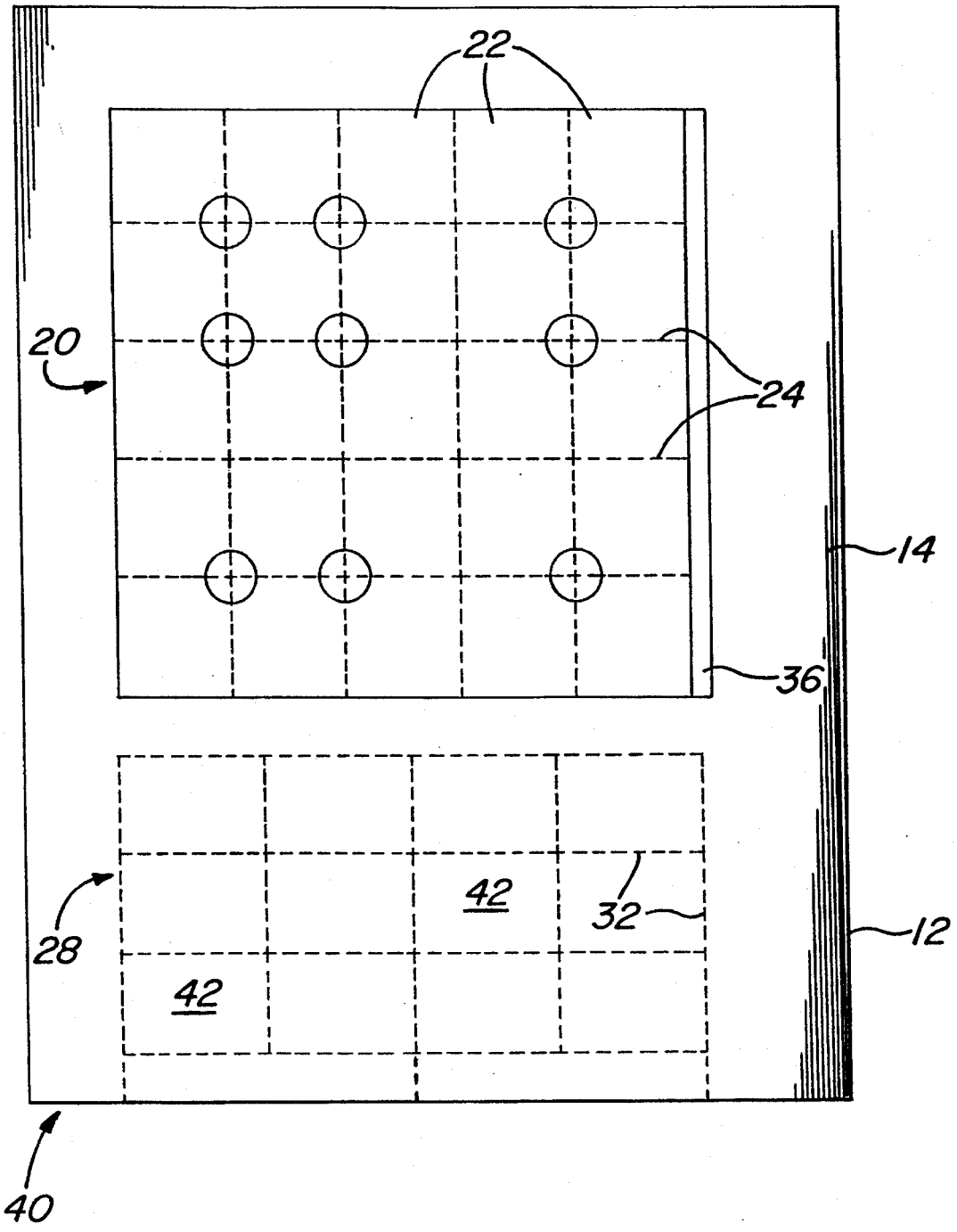
FIG. 3 is a top view of a label sheet of a second embodiment of the present invention.
Figure 4:
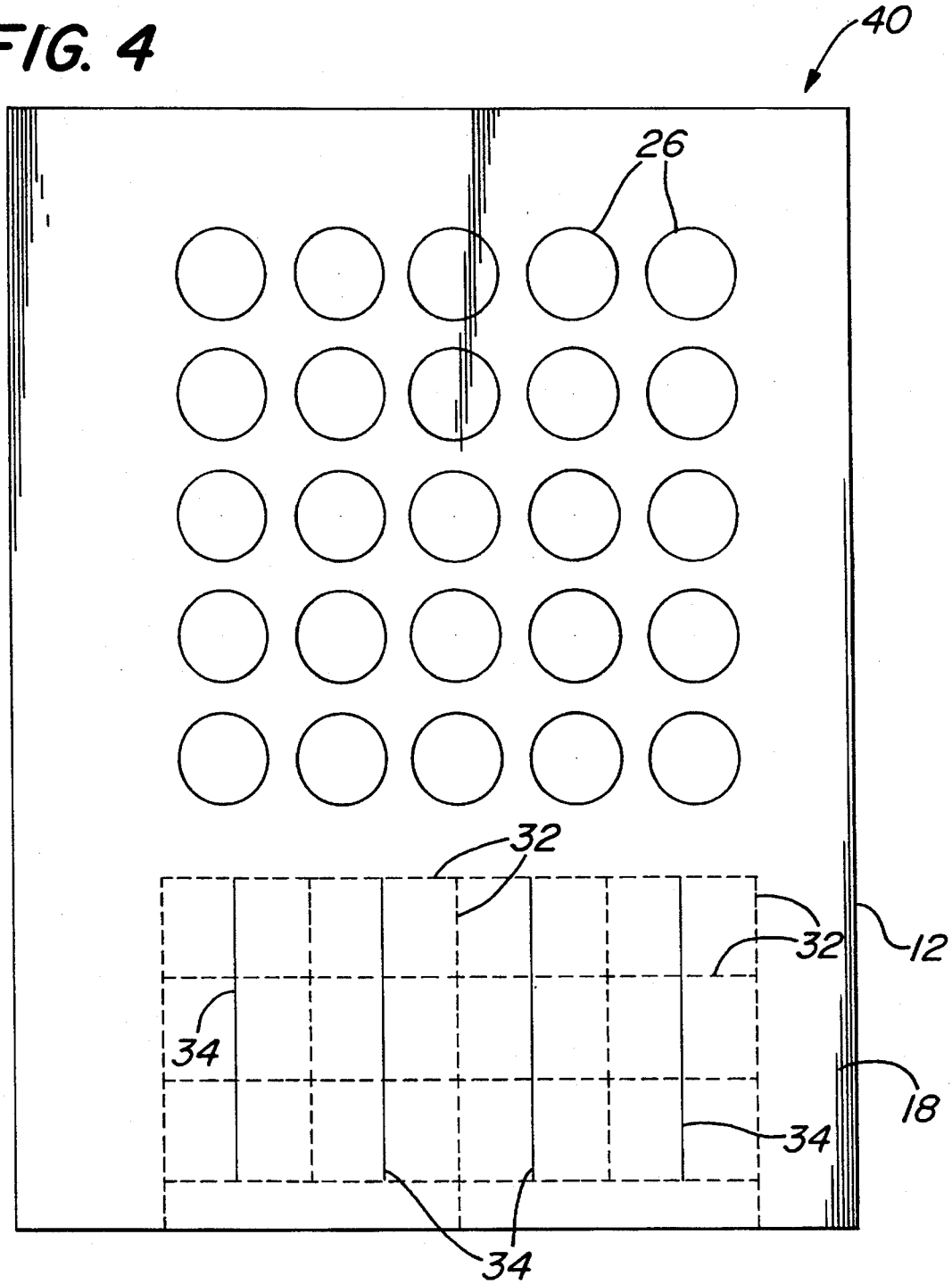
FIG. 4 is a bottom view of the label sheet of FIG. 3.

Shown in FIGS. 3 and 4, is a second embodiment 40 of the invention, bearing reference characters similar to those of sheet 14 for similar parts, except that the lower portion of the sheet 40 provides twelve labels 42, instead of the six labels 30 shown in FIGS. 1 and 2.

Without further elaboration the foregoing will so fully illustrate my invention that others may, by applying current or future knowledge, adapt the same for use under various conditions of service.

I claim:

1. In a medicinal dispensing system comprising in combination, (1) a sheet and (2) a medicinal dispensing device having a plurality of individual units, each unit including:

(i) flanges having corners and being detachably connected along certain lines so that each flange may be separated from the remaining flanges, and (ii) a chamber depending from each flange, the chamber having an outer opening, with the chamber being adapted to hold an article, said sheet comprising a plurality of closure members, each closure member adapted to cover one of the chamber openings, the sheet having an interior surface which is adapted to be in contact with the flanges of the medicinal device, the interior surface of the sheet carrying a tacky adhesive temporarily covered by a protective cover which will contact the flanges of the medicinal device when the protective cover is removed from the interior surface of the sheet and attached so that the interior surface above each respective chamber in each unit will be protected from adherence to an article within each chamber by the interior surface above each chamber being covered with a portion of the protective cover, the closure members of said sheet being defined by perforated lines closely corresponding to the flange lines, at least one corner of each flange being removed in a cut-away area to facilitate separation of a closure member from the chamber by removing the closure member from the corresponding chamber, the flanges being detachably connected along first and second groupings of weakened lines, generally perpendicular to each other, the weakened lines meeting in intersections and there being a punched opening at some of the intersections, the improvement comprising the closure members for the units of the medicinal dispensing device being located adjacent one another on an upper section of the sheet which is approximately 8.5 inches by 11 inches in dimension, the sheet having an outer surface for printing indicia thereon, the interior surface of the sheet including the tacky adhesive and the protective cover sheet releasably secured thereto to prevent the adherence of the closure members to an undesired object, the sheet further comprising:

(a) an upper portion comprising the closure members constituting individual unit labels of a first size, each of the unit labels having corners and being detachably connected along certain perforated lines so that each unit label may be separated from remaining unit labels to act as the closure member for each respective chamber associated therewith, and (b) a lower portion comprising a plurality of secondary labels, the secondary labels and underlying associated protective cover sheet being perforated along certain lines, the secondary labels being detachably connected along certain perforated lines so that at least one of the secondary labels may be separated from the remaining secondary labels while each secondary label still maintains its protective cover.

* * * * *